US005832847A

United States Patent [19]

Leisse et al.

[11] Patent Number: 5,832,847

[45] Date of Patent: Nov. 10, 1998

[54] METHOD AND APPARATUS FOR THE REDUCTION OF NOX GENERATION DURING COAL DUST COMBUSTION

[75] Inventors: Alfons Leisse, Essen; Michael Streffing, Marl, both of Germany

[73] Assignee: Babcock Lentjes Kraftwerkstechnik GmbH, Oberhausen, Germany

[21] Appl. No.: 666,077

[22] Filed: Jun. 19, 1996

[30] Foreign Application Priority Data

Jul. 25, 1995 [DE] Germany ..... 195 27 083.5

[51] Int. Cl.[6] ..... F23D 1/00; F23D 14/00; F23L 1/00

[52] U.S. Cl. ..... 110/347; 110/344; 110/348; 110/261; 431/5

[58] Field of Search ..... 431/8, 9, 278, 431/284, 285, 115, 5, 181, 187; 110/347, 341, 348, 261, 262, 263, 229, 104 B, 342, 344, 345

[56] References Cited

U.S. PATENT DOCUMENTS

| | | | |
|---|---|---|---|
| 4,249,470 | 2/1981 | Vatsky | 110/232 |
| 4,380,202 | 4/1983 | LaRue et al. | 110/263 |
| 4,659,305 | 4/1987 | Nelson et al. | 431/9 |
| 4,790,743 | 12/1988 | Leikert et al. | 431/8 |
| 5,092,761 | 3/1992 | Dinicolantonio | 431/3 |
| 5,215,455 | 6/1993 | Dykema | 431/3 |
| 5,216,968 | 6/1993 | Capek et al. | 110/346 |
| 5,231,937 | 8/1993 | Kobayashi et al. | 110/262 |
| 5,411,394 | 5/1995 | Beer et al. | 431/9 |
| 5,568,777 | 10/1996 | Breen et al. | 110/261 |
| 5,603,906 | 2/1997 | Lang et al. | 422/182 |
| 5,634,785 | 6/1997 | Bury et al. | 431/9 |
| 5,651,320 | 7/1997 | Leisse et al. | 110/262 |
| 5,687,658 | 11/1997 | Streffing et al. | 110/347 |
| 5,688,115 | 11/1997 | Johnson | 431/9 |

FOREIGN PATENT DOCUMENTS

| | | |
|---|---|---|
| 42 17 879 A1 | 12/1993 | Germany . |
| 60-78206 | 5/1985 | Japan . |

*Primary Examiner*—Ira S. Lazarus
*Assistant Examiner*—Ljiljana V. Ciric
*Attorney, Agent, or Firm*—Max Fogiel

[57] ABSTRACT

The process for combustion of coal dust with combustion air in burners and for reducing the production of $NO_x$ during the combustion. Combustion air is fed to the burners in form of primary air and secondary air. The burners are supplied coal dust through the primary air in a mixture of coal dust and primary air. A primary gas is generated with combustible gaseous components from the mixture of coal dust and primary air, through pyrolysis of the coal dust in the ignition region of the burners. In the ignition region, there is lowered the mean ratio of oxygen components in the primary gas to the oxygen amount required to burn freely released combustible gaseous components of the primary gas by reducing the oxygen component in the primary gas and/or injecting the primary gas with a combustible external gas.

7 Claims, 4 Drawing Sheets

METHOD AND APPARATUS FOR THE REDUCTION OF NOX GENERATION DURING COAL DUST COMBUSTION

BACKGROUND OF THE INVENTION

The invention relates to a process for the reduction of $NO_x$ generated during combustion of coal dust and combustion air in burners.

In the combustion of carbon-containing fuels, combustion air is generally added in stages as multiple partial streams to reduce the amount of $NO_x$ generated. The fuel is thereby combusted in a first flame zone with deficient air supply and reduced flame temperature. The remaining combustion air is subsequently mixed with the flame in a second flame zone.

A coal dust burner with staged air supply is known from German published application DE-OS 42 17 879. In that burner, the air streams are supplied through helical entry housings and flow through concentrical annular channels wherein they are provided with an angular momentum. The secondary and tertiary air stream are outwardly deflected by way of deflector grooves and away from the fuel stream which is supplied through an undivided annular channel positioned between the core air pipe and a secondary air channel. This provides for an inner combustion zone with a low air number and a relatively more oxygen rich, stable flame sheath from which the fuel rich flame is gradually supplied with oxygen.

SUMMARY OF THE INVENTION

It is an object of the invention to influence the generation of $NO_x$ during the ignition phase of the coal dust.

The invention is based on the reasoning that the generation of $NO_x$ during the combustion of coal dust in steam generators is mainly influenced by the air ratio in a fire box of the steam generator, the combustion temperature, the fuel consistency and especially the oxygen quotient ω, which is present at the time of the primary reaction, i.e. during the pyrolysis and the parallel oxidation of the volatile coal components. The oxygen quotient ω is defined as the ratio of the oxygen available during the ignition phase to the oxygen required for combustion of the released gaseous volatile components. At the beginning of the pyrolysis phase, the portion of the released volatile components $\gamma_{volatile\ components}$, which are released from the coal in gaseous form is small (FIG. 1). Thus, the absolute amount of oxidizable products and the correspondingly required amount of oxygen for their combustion is very small. This is in contrast to a fixed amount of oxygen which is the sum of the primary air and the inherent oxygen portion of the fuel. This means that the oxygen quotient ω is infinitely large at the beginning of the ignition of the volatile components. Given that initially no new oxygen is added, for example, in the form of combustion air, the oxygen quotient ω decreases in the following due to the progressing reactions in the flame core in the region adjacent the burner (FIG. 2). With the onset of the admixture of secondary and tertiary air to the primary reaction, the oxygen quotient ω increases again. If this occurs at a point in time where the pyrolysis reaction of the coal is not completed, the production of $NO_x$, is accelerated. The dependency of the combustion gas $NO_x$ content $\gamma_{NOx}$ from the oxygen quotient ω is shown in FIG. 3.

Using details on the composition of the fuel, and primarily its tendency to pyrolyse and a number of peripheral conditions of the firing system, one can calculate the mean oxygen quotient ω for all burner constructions. With the measures in accordance with the invention, the maximum and mean values of the oxygen quotient ω can be influenced such that a minimum of $NO_x$ is generated without bringing down the processes which are required for maintaining the primary reactions at the burner mouth.

BRIEF DESCRIPTION OF THE DRAWINGS

The invention is described in the following by way of several exemplary embodiments and burners for carrying out the invention. It is shown in FIG. 1 a diagram of the change in the amount of liberated volatile components in the primary gas over time during the ignition phase.

DESCRIPTION OF THE PREFERRED EMBODIMENTS

Figure 1:
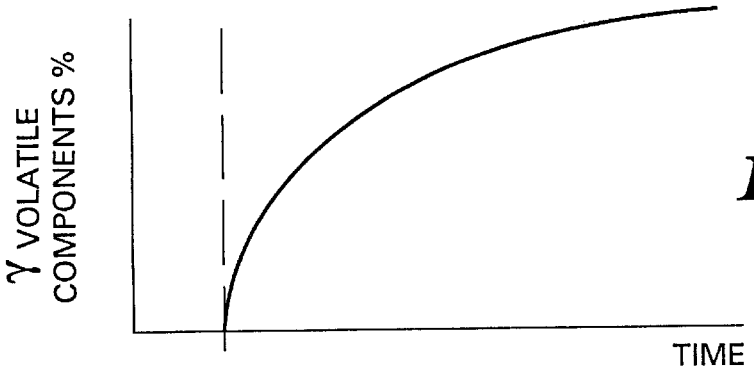
Figure 2:
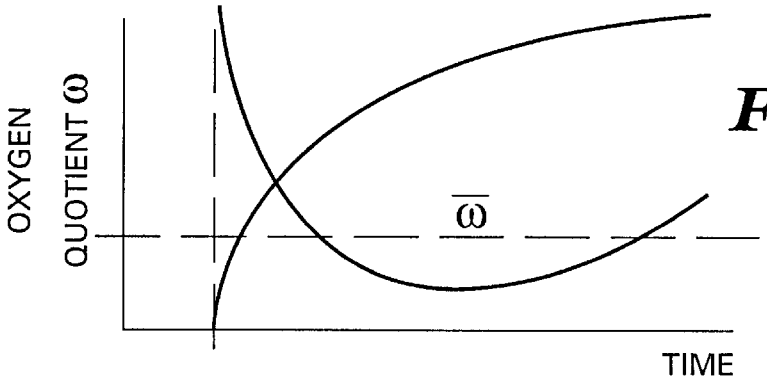
FIG. 2 a diagram illustrating the change of the oxygen quotient ω over time during the ignition phase.
Figure 3:
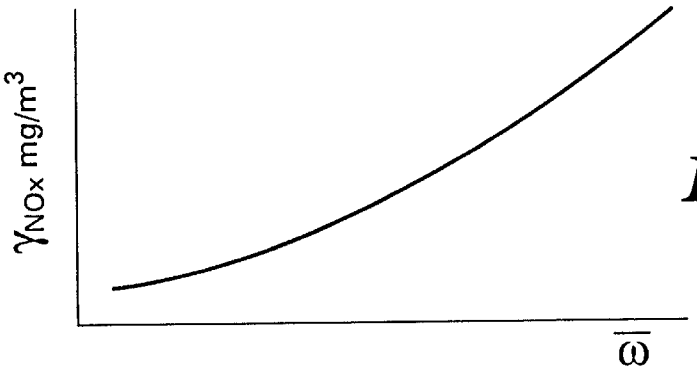
FIG. 3 a diagram of the dependency of the $NO_x$, content in the combustion gas on the oxygen quotient.
Figure 4:
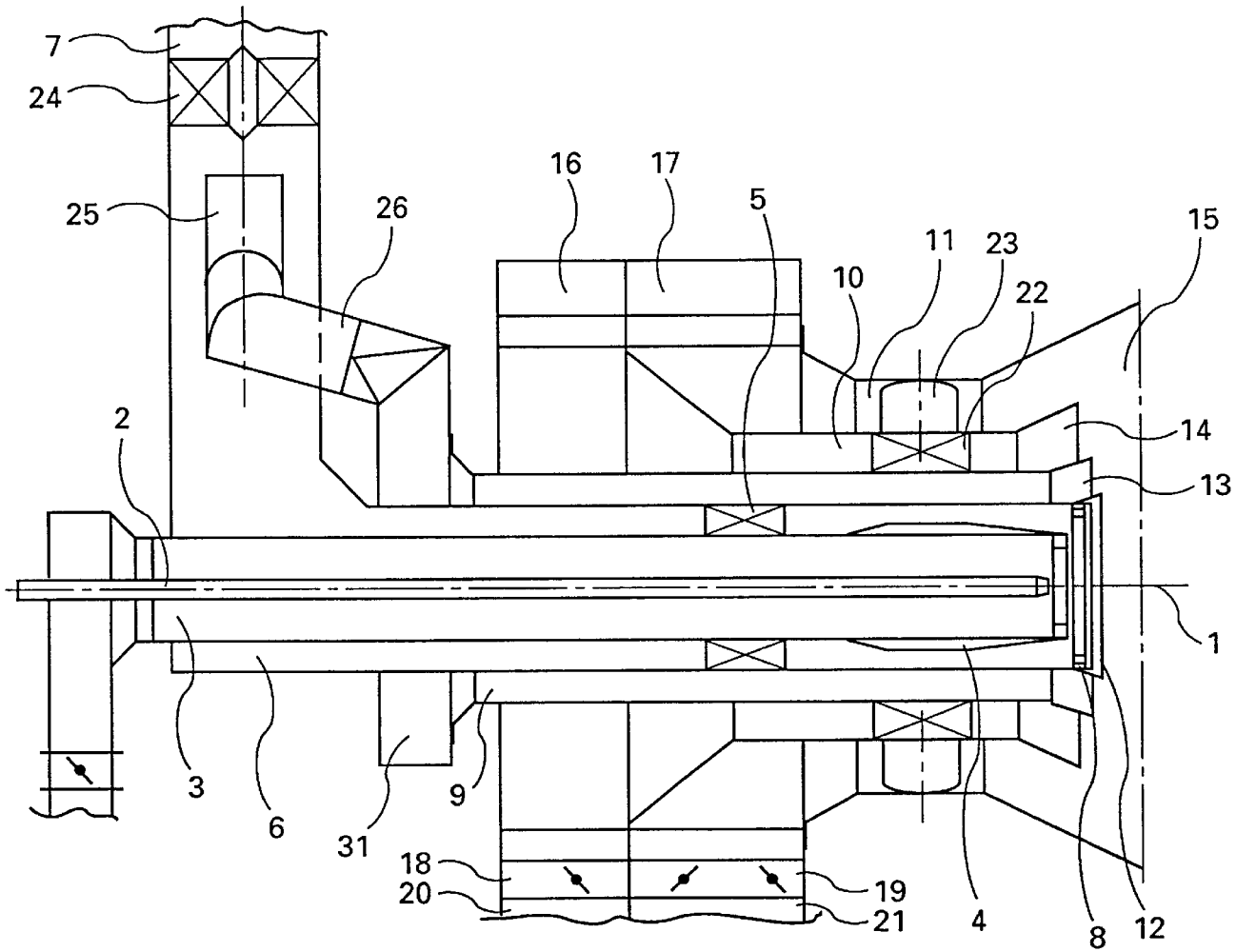
FIG. 4 a longitudinal section through a burner.
Figure 5:
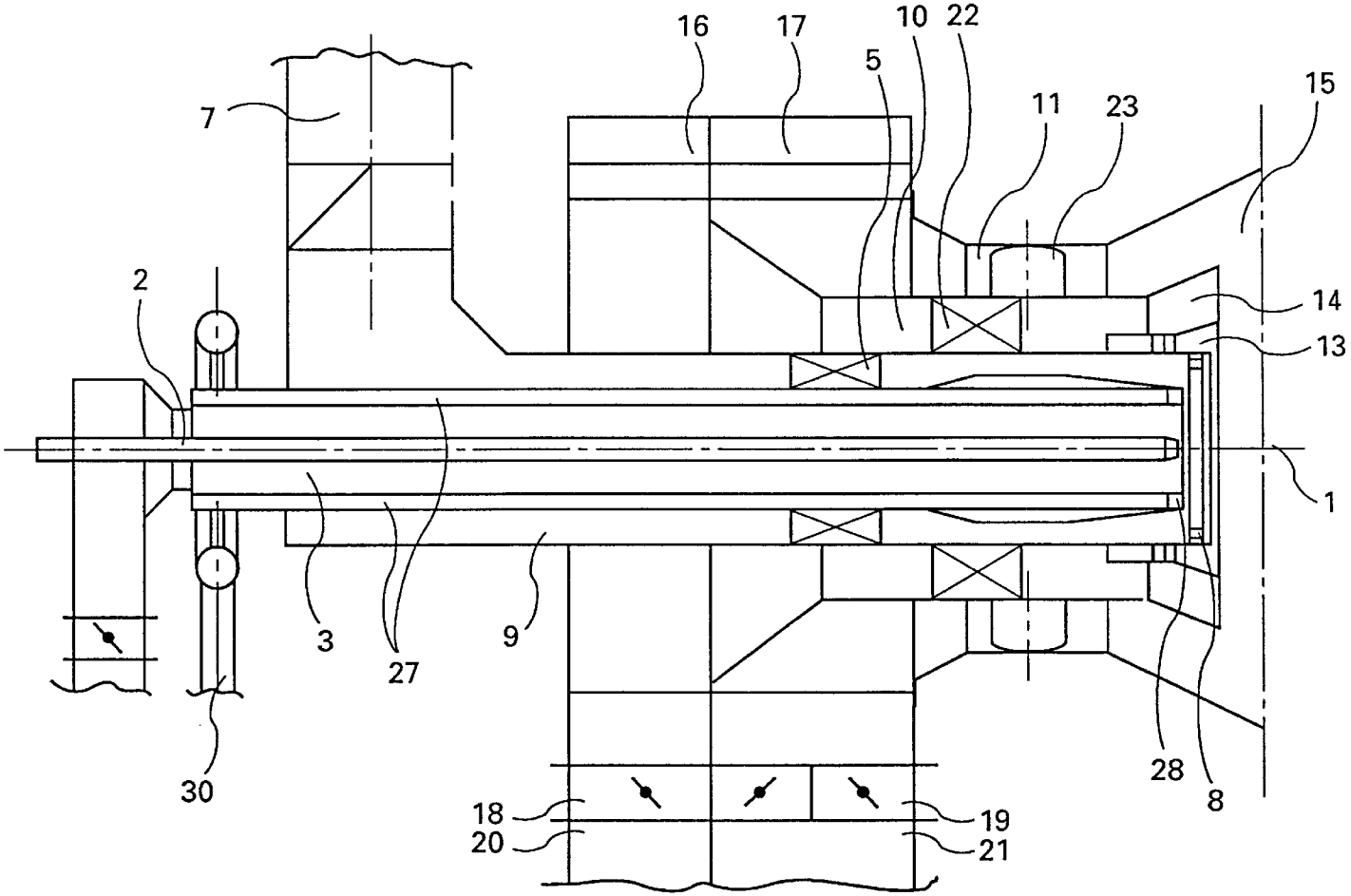
FIG. 5 a longitudinal section through a second burner.
Figure 6:
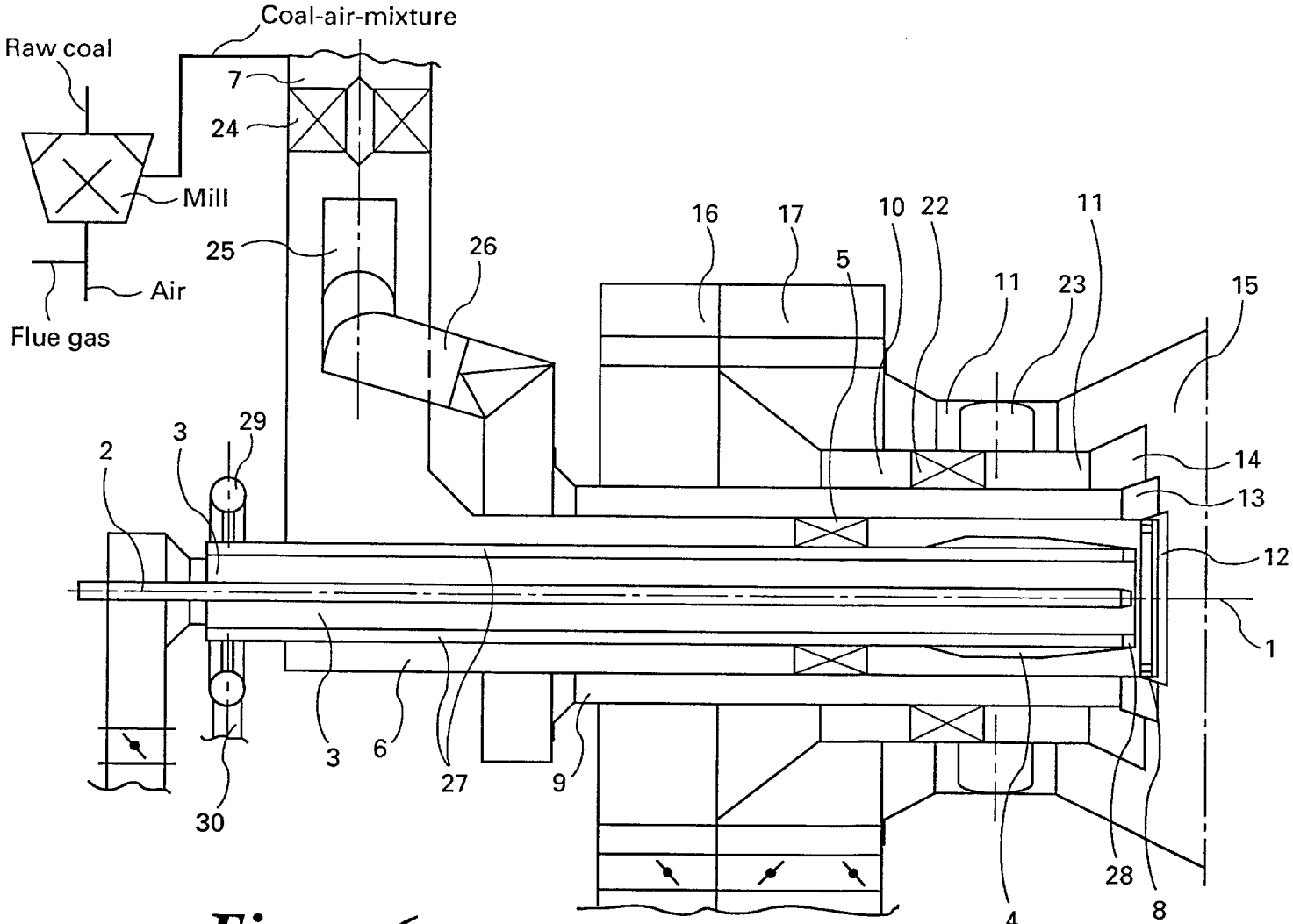
FIG. 6 a longitudinal section through a third burner.

The illustrated burner in FIGS. 4–6 includes an oil burner ignition lance 2 which is positioned inside a core air pipe 3 and coaxial with the longitudinal axis 1 of the burner. The core air pipe 3 is surrounded by a primary dust conduit 6 and together therewith defines a cylindrical, annular channel. An angular momentum creating deflector 5 is positioned in the primary dust conduit 6 and behind a flow controlling body 4 positioned on the core air pipe 3 and at the front end thereof.

An elbow connects the reward end of the primary dust conduit 6 with a dust conduit 7 which leads to a mill (not illustrated). A mixture of primary air and coal dust is supplied to the primary dust conduit 6 through dust conduit 7. Inserts in the form of a stabilizer ring 8 which has a radially inwardly directed edge are installed at the exit end of the primary dust conduit 6. This radially inwardly directed edge protrudes into the stream of primary air and coal dust.

The primary dust conduit 6 is concentrically positioned in a first annular channel which is defined by a primary gas tube 9. This annular channel is surrounded by a secondary air tube 10 which defines a second cylindrical annular channel and the second air tube 10 is concentrically surrounded by a tertiary air tube 11 defining a third cylindrical annular channel. The exit ends of the primary dust conduit 6, the primary gas tube 9 and the secondary air tube 10 each have an outwardly conically flared section. These sections provide deflectors 12, 13, 14 for the medium stream which is respectively guided along the outside thereof. The tertiary gas tube 11 continues into the outwardly flared burner throat.

The rear ends of the secondary air tube 10 and a tertiary air tube 11 of the burner are respectively connected to a spiral input housing 16, 17. Input conduits 20, 21 of the respective input housings 16, 17 provide the secondary air tube 10 with secondary air and the tertiary air tube 11 with tertiary air as partial streams of the combustion air and are respectively provided with dampers 18, 19. The input housings 16, 17 provide for an even distribution of the secondary and tertiary air throughout the cross section of the secondary air tube 10 and the tertiary air tube 11 respectively.

An angular deflector is respectively positioned in the secondary air tube 10 and a tertiary air tube 11 and adjacent the respective exit end for control of the angular momentum of the air stream, which deflector includes rotatably supported axial dampers 22, 23 which are adjustable from the outside by way of a driven rod linkage (not illustrated). These axial dampers 22, 23 impose a selected angular momentum onto the secondary and tertiary air. Depending on their angle relative to the air stream, these axial dampers 22, 23 increase or decrease the angular momentum of the air stream created by the input housing 16, 17 respectively. In special situations, the angular momentum can be completely cancelled.

An angular deflector body 24 is positioned in the dust conduit 7 and in proximity to the entry thereof into the burner which deflector divides the mixed stream of primary air and coal dust into a dust rich outer partial stream and an inner partial stream of low dust content. A dip tube 25 is positioned in the dust conduit 7 and in direction of flow after the deflector body 24. A conduit 26 which is connected to the dip tube 25 exits the dust conduit 7 and is connected through a radial entry housing 31 with the primary gas tube 9. With this arrangement, the partial stream of low dust content is removed from the divided mixed stream and guided to the primary gas tube 9, while only the dust rich and, thus, relatively air deficient partial stream enters the primary dust conduit 6. In this way, a relative enrichment with coal dust and, thus, volatile components is achieved in the ignition region of the burner with a simultaneous reduction of the available oxygen. This results in reduction of the oxygen quotient ω.

The burner illustrated in FIG. 5 substantially corresponds in construction to the one shown in FIG. 4. However, the dust conduit 7 does not include a deflector body which separates the mixture stream into two partial streams. Instead, a gas pipe 27 is positioned around the core air pipe 3 which together with the core air pipe defines an annular channel that is closed at its exit end by a nozzle plate 28. This nozzle plate 28 is provided with circumferentially positioned gas exit nozzles. The gas pipe 27 is connected to an annular conduit 29 which is connected with the supply line 30 for a combustible external gas, for example, natural gas, methane or coking gas. The external gas is fed through the nozzle plate 28 and into the primary ignition zone which establishes itself downstream of the primary dust tube 6.

The burners shown in FIGS. 4 and 5 may also be combined into a burner as illustrated in FIG. 6.

When sufficient heat is transferred to the fuel in the primary air-coal dust mixture exiting the primary dust conduit 6, pyrolysis of the coal dust commences right after ignition. A mixture is thereby created in the primary ignition zone which includes the volatile components of the coal which are released in gaseous form. It is a goal of the process in accordance with the invention to reduce the quotient ω of the oxygen in the primary gas to the oxygen required for combustion of the volatile components present in the primary gas. To this end, the mixture stream is divided into a dust rich partial stream and a partial stream of low dust content, and the partial streams with differing dust loading are fed to the ignition region of the burner. Because of this division, the dust content in the generated primary gas is increased and, simultaneously, the available oxygen in this area is reduced. The separation into two partial streams with differing dust loading is preferably carried out in the dust conduit 7 immediately adjacent the burner. It is also possible to provide for the division at another location of the firing system.

The reduction in the oxygen quotient in the primary gas can also be achieved by replacing part of the air in the primary air-coal dust mixture with flue gas. This flue gas, which can be hot or cooled is admixed with the air by mixer 7*a* prior to its entry into the mill.

In another process for the reduction of the oxygen quotient ω in the primary gas, a combustible external gas is fed into the primary gas through the above-described gas pipe 27. In this way, the portion of reactive volatile fuel products in the primary gas is increased and, consequently, the oxygen deficiency in the primary gas is also increased. The amount of the external gas can be up to 20% of the burner capacity.

The embodiments of the invention in which an exclusive property or privilege is claimed are defined as follows:

1. A process for combustion of coal dust with combustion air in burners and for reducing production of $NO_x$ during said combustion at a site where the $NO_x$ is generated, said process comprising the steps of: feeding primary air and secondary air as combustion air to said burners, said primary air comprising an amount of oxygen; feeding a mixture of coal dust and primary air to said burners; generating a primary gas comprising said primary air and also comprising combustible gaseous components produced from said mixture through pyrolysis of the coal dust in an ignition region of said burners; injecting said primary gas with a combustible external gas to lower, in said ignition region, a mean ratio of said amount of oxygen in said primary gas to an amount of oxygen required to burn freely released combustible gaseous components of said primary gas by decreasing the amount of oxygen in said primary gas; dividing said mixture into a high-dust-content partial stream and a low-dust-content partial stream so that the low-dust-content partial stream is separated from the secondary air by the high-dust-content partial stream and the production of $NO_x$ is decreased by preventing generation of $NO_x$ at said site; whereby the ignition region influences generation of $NO_x$.

2. A process as defined in claim 1, including the step of relative enrichment with coal dust in said mixture.

3. A process as defined in claim 1, including the step of replacing a part of the primary air with flue gas in said mixture.

4. A process as defined in claim 1, wherein each burner has a given capacity and wherein said combustible external gas is present in an amount of up to 20% of the burner capacity.

5. A process for combustion of coal dust with combustion air in burners and for reducing production of $NO_x$ during said combustion at a site where the $NO_x$ is generated, said process comprising the steps of: feeding primary air and secondary air as combustion air to said burners, said primary air comprising an amount of oxygen; feeding a mixture of coal dust and primary air to said burners; generating a primary gas comprising said primary air and also comprising combustible gaseous components produced from said mixture through pyrolysis of the coal dust in an ignition region of said burners; injecting said primary gas with a combustible external gas to lower, in said ignition region, a mean ratio of said amount of oxygen in said primary gas to an amount of oxygen required to burn freely released combustible gaseous components of said primary gas; dividing said mixture into a high-dust-content partial stream and a low-dust-content partial stream so that the low-dust-content partial stream is separated from the secondary air by the high-dust-content partial stream and the production of $NO_x$ is decreased by preventing generation of $NO_x$ at said site; whereby the ignition region influences generation of $NO_x$.

6. A process as defined in claim 5, including the steps of suppressing emission of $NO_x$ at said site where said $NO_x$ is generated; generating oxidizable combustible products by pyrolysis, oxygen being a reaction partner and heat energy being present for igniting the coal dust, a portion of said combustible gaseous components being freely released through pyrolysis of the solid coal dust and being subsequently burned, using oxygen.

7. A process for combustion of coal dust with combustion air in burners and for reducing production of $NO_x$ during said combustion at a site where the $NO_x$ is generated, said process comprising the steps of: feeding primary air and secondary air as combustion air to said burners, said primary air comprising an amount of oxygen; feeding a mixture of coal dust and primary air to said burners; generating a primary gas comprising said primary air and also comprising combustible gaseous components produced from said mixture through pyrolysis of the coal dust in an ignition region of said burners; injecting said primary gas with a combustible external gas to lower, in said ignition region, a mean ratio of said amount of oxygen in said primary gas to an amount of oxygen required to burn freely released combustible gaseous components of said primary gas by decreasing the amount of oxygen in said primary gas; suppressing emission of $NO_x$ at the site where said $NO_x$ is generated; generating oxidizable combustible products by pyrolysis, oxygen being a reaction partner and heat energy being present for igniting the coal dust, a portion of said combustible gaseous components being freely released through pyrolysis of the coal dust and being subsequently burned using oxygen; dividing said mixture into a high-dust-content partial stream and a low-dust-content partial stream so that the low-dust-content partial stream is separated from the secondary air by the high-dust-content partial stream and the production of $NO_x$ is decreased by preventing generation of $NO_x$ at said site; whereby the ignition region influences generation of $NO_x$.

* * * * *